United States Patent [19]

Gordon

[11] 3,964,160

[45] June 22, 1976

[54] SAFETY RAZOR WITH AN ANGULARLY ADJUSTABLE HEAD

[76] Inventor: Garron Gordon, 3051-C Via Serrena South, Laguna Hills, Calif. 92653

[22] Filed: Apr. 2, 1975

[21] Appl. No.: 564,538

[52] U.S. Cl. ..... 30/89

[51] Int. Cl.[2] ..... B26B 21/52

[58] Field of Search ..... 30/48, 89, 87

[56] References Cited

UNITED STATES PATENTS

| | | | |
|---|---|---|---|
| 489,995 | 1/1893 | Stenberg | 30/89 X |
| 1,247,581 | 11/1917 | Seitz | 30/89 |
| 1,581,694 | 4/1926 | Smith | 30/48 |

*Primary Examiner*—Al Lawrence Smith
*Assistant Examiner*—Gary L. Smith
*Attorney, Agent, or Firm*—Harvey C. Nienow

[57] ABSTRACT

A safety razor wherein the blade-retaining head can be positioned in any one of a plurality of pivotal relative positions between said head and a handle. It comprises a handle which is pivotally connected to a head, the latter of which is adapted to retain a safety razor blade. An arcuately-shaped indexing member having a plurality of angularly-spaced notches is fixed to the head, and spring-biased locking means is positioned on the handle for engagement with the indexing member.

1 Claim, 5 Drawing Figures

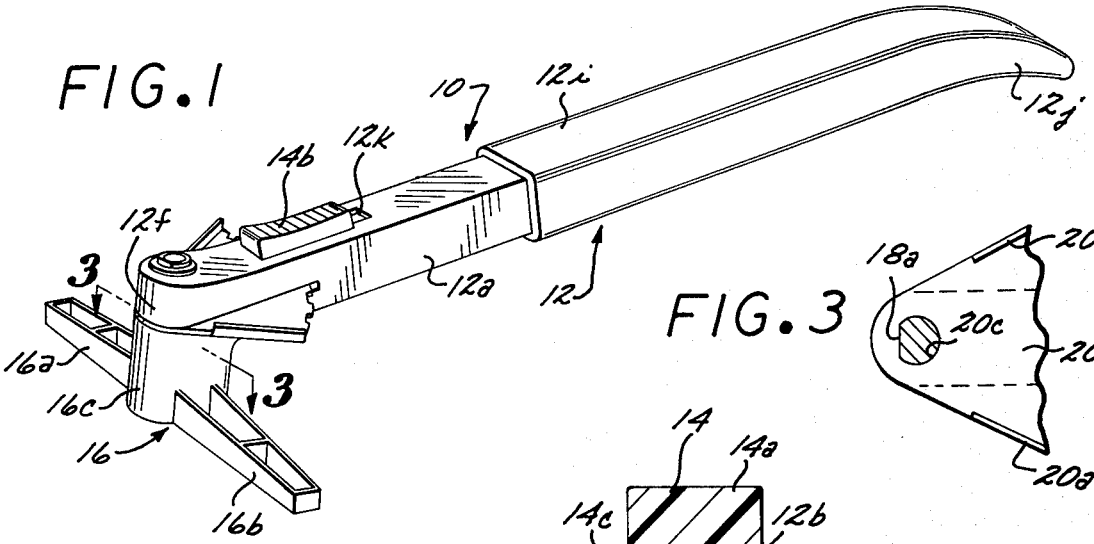
FIG. 1
FIG. 3
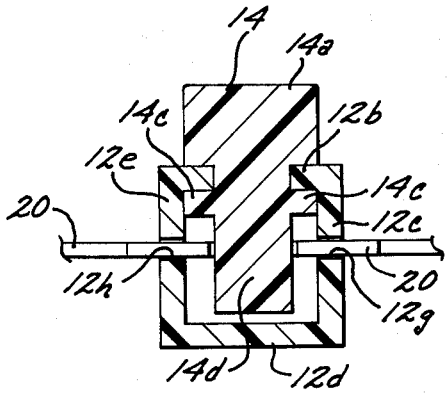
FIG. 5
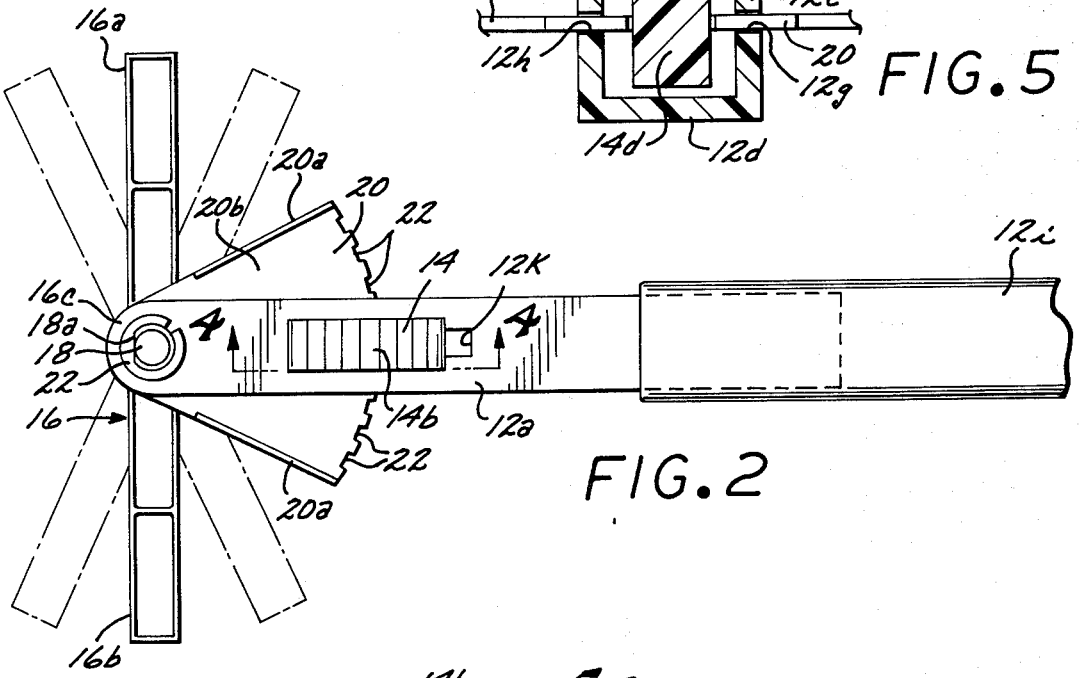
FIG. 2
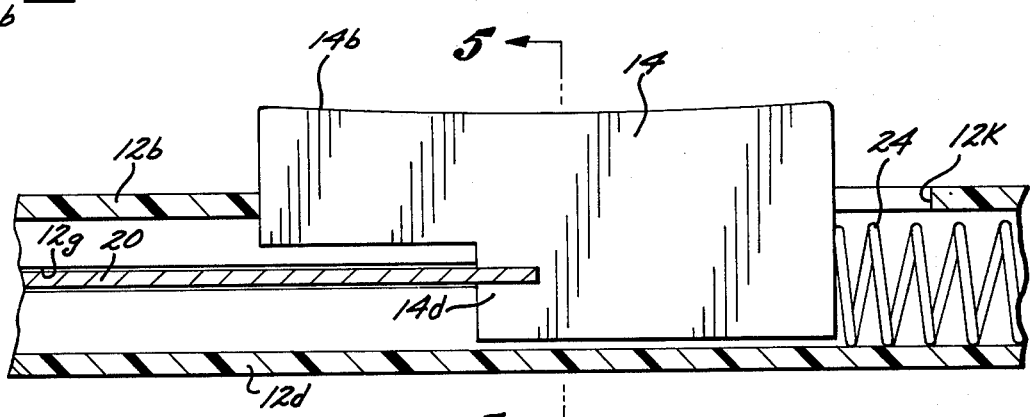
FIG. 4

SAFETY RAZOR WITH AN ANGULARLY ADJUSTABLE HEAD

The present invention relates generally to safety razors, and more particularly to blade-type shaving devices wherein the cutting or shaving angle can be varied.

Safety razors have, by and large, undergone very little change within the past three or four decades, until very recently when special emphasis was given to the cutting or shaving function provided thereby. For instance, within the past several years, safety razors having a pair of parallel blades have been introduced in the marketplace with the claim that better and closer shaves can be obtained therewith.

It has been realized that it would be beneficial to have a safety razor wherein, to minimize the irritation and to increase the shaving or cutting effectiveness, the blade would be drawn across the person's face at an angle to the direction of movement. This would enable the gentlemen's beard, or the ladies' undesirable hair, to be sliced or cut at an angle.

To this end, the present invention provides a safety razor wherein the cutting or shaving blade can be disposed at any one of a plurality of different angular positions relative to a handle member.

Another object of the present invention is to provide a safety razor as characterized above wherein an indexing mechanism is provided for enabling the gentleman or lady to position the head in substantially any desired angular position.

A still further object of the present invention is to provide a safety razor as characterized above which employs spring-biased locking means for locking the razor head or blade in any appropriate angular position.

An even further object of the present invention is to provide a safety razor as characterized above which is simple and inexpensive to manufacture and which is rugged and dependable in operation.

The novel features which I consider characteristic of my invention are set forth with particularity in the appended claims. The device itself, however, both as to its organization and mode of operation, together with additional objects and advantages thereof, will best be understood from the following description of specific embodiments when read in connection with the accompanying drawings, in which:

FIG. 1 is a perspective view of a safety razor according to the present invention;

FIG. 2 is a fragmentary top plan view of the razor of FIG. 1;

FIG. 3 is a fragmentary sectional view taken substantially along line 3—3 of FIG. 1;

FIG. 4 is a fragmentary sectional view taken substantially along line 4—4 of FIG. 2; and FIG. 5 is a fragmentary sectional view taken substantially along line 5—5 of FIG. 4.

Like reference characters indicate corresponding parts throughout the several views of the drawings.

Referring to FIG. 1 of the drawings, there is shown therein a safety razor 10 according to the present invention.

Such razor 10 comprises a handle 12 which, although shown in FIG. 1 as being made in two parts, may be made in a single part in accordance with the present invention. A forward handle section 12*a* is formed of plastic, sheet steel or the like and, as generally shown in FIG. 5 of the drawings, is provided with a relatively square cross-section having side walls 12*b*, 12*c*, 12*d* and 12*e*. Handle section 12*a* is provided with an arcuate end portion 12*f* wherein there is provided a through opening. A longitudinal slot 12*g* is formed in side wall 12*c* and a similar horizontal slot 12*h* is formed in side wall 12*e*. Such slots 12*g* and 12*h* are aligned so as to receive a member which will hereinafter be described.

Another handle section 12*i* is mounted on section 12*a* in any appropriate manner as by bonding, press-fitting or the like, and is formed of suitable plastic material to provide a comfortable handle for the user of safety razor 10. The end portion 12*j* of section 12*i* may be curved to facilitate such comfortable handling of the entire razor.

Handle section 12*a* is further formed with a cutout 12*k* in the wall 12*b*. A plastic finger-operated lever 14 is positioned in such cutout.

Lever 14 comprises an enlarged end portion 14*a* which extends outside of the handle section 12*a* and which is provided with a knurled upper surface 14*b*. A pair of shoulders 14*c* are formed on either side of the main body of lever 14 to enable such lever to slide within cutout 12*k* relative to handle section 12*a*. Lever 14 is further provided with a depending or detent portion 14*d*, the use of which will be hereinafter explained.

A razor head 16 is provided as part of safety razor 10, and is adapted to receive and retain a safety razor blade. Several extensions 16*a* and 16*b* are to facilitate such function of head 16.

Head 16 is formed with a central mounting boss 16*c* which is arcuately shaped to correspond to the arcuate shape of end portion 12*f* of handle section 12*a*, and a pivot pin 18 is firmly mounted therein. Such pin 18 extends above the head 16, through the aforementioned through opening in end portion 12*f* of handle section 12*a*. Head 16 may be formed of any appropriate plastic material, and the pivot pin 18 may be formed of steel, plastic or the like and press-fitted into mounting boss 16*c*.

Inperposed between mounting boss 16*c* and end portion 12*f* is an indexing member 20. Such member is formed with a through opening for receiving pin 18 as shown in FIGS. 1, 2 and 3 of the drawings, and is also provided with a pair of angularly disposed side walls or limit stops 20*a*. In addition thereto, indexing member 20 is provided with a generally curved or arcuate marginal edge 20*b* which is provided with a plurality of spaced notches 22. Such notches are formed with such dimensions as to receive the detent portion 14*d* of lever 14.

To position indexing member 20 in fixed relation to head 16, the pivot pin 18 is formed with a longitudinal flat surface 18*a* and the opening 20*c* of indexing member 20 is complementally shaped as shown in FIG. 3 of the drawings. With this arrangement, the indexing member 20 is easily mounted on the pin 18, but only in the proper orientation therewith to prevent relative movement between member 20 and head 16. A snap ring 22 for cooperation in a suitable annular ridge or groove in the end of pivot pin 18 may be provided against end portion 12*f* of handle section 12*a* to retain the various members in assembled relation.

To retain the head 16 in a fixed position relative to handle 12, a compression spring 24 is mounted within handle section 12*a* to urge lever 14 against indexing member 20.

In operation, with the razor head 16 provided with an appropriate razor blade (not shown), the desired angle between the handle 12 and such blade can be adjusted as desired. This is accomplished merely by the operator retracting the lever 14 against the force of compression spring 24 and thereafter the entire head, including the indexing member 20 may be rotated to the desired relative angular position. Thereafter, release of lever 14 causes the compression spring 24 to move such lever forward into the appropriate notch 22 of member 20. Several of such angular relative positions are shown in broken lines in FIG. 2 of the drawings. The stop members or shoulders 20*a* maintain the indexing member 20 in proper disposition relative to handle section 12*a* since such shoulders engage the said handle section when the extreme angular positions are reached.

Although I have shown and described certain specific embodiments of my invention, I am well aware that many modifications thereof are possible.

I claim:

1. A safety razor comprising in combination, a handle formed with a relatively square cross section, a head adapted to receive and retain a safety razor blade and formed with a relatively flat boss for cooperation with one side of said square cross section of said handle, a pivot pin fixed to said head and extending from said relatively flat boss, said handle being formed with an opening for receiving said pin, said pivot pin being generally cylindrical permitting pivotal movement of said head relative to said handle and formed with a longitudinal flat surface, a relatively flat indexing member interposed between said boss and said handle and being formed with a generally circular through opening for receiving said pin, said opening having a non-circular portion for cooperation with the flat surface of said pin to prevent relative rotation between said head and said indexing member, said indexing member being preformed with offset marginal opposite edges which constitute limit stops for limiting the amount of rotational movement of said head on said handle, one of said sides of said cross section of said handle being formed with a rectangular cutout, locking means rectilinearly movable on said handle within said rectangular cutout between positions of engagement and disengagement with said indexing member, and means biasing said locking member toward said position of engagement with said indexing member.

* * * * *